US008459823B1

(12) United States Patent
Steele et al.

(10) Patent No.: US 8,459,823 B1
(45) Date of Patent: Jun. 11, 2013

(54) SCREEN ENCLOSURE LIGHTING SYSTEM

(76) Inventors: Robert E. Steele, Fort Myers, FL (US); Jeffrey S. Steele, Fort Myers, FL (US)

( * ) Notice: Subject to any disclaimer, the term of this patent is extended or adjusted under 35 U.S.C. 154(b) by 231 days.

(21) Appl. No.: 12/925,459

(22) Filed: Oct. 21, 2010

Related U.S. Application Data

(60) Provisional application No. 61/279,431, filed on Oct. 21, 2009.

(51) Int. Cl.
*F21S 8/00* (2006.01)

(52) U.S. Cl.
USPC ..... 362/145; 362/244; 362/246; 362/432

(58) Field of Classification Search
USPC ..... 362/147, 145, 146, 150, 249.11, 362/234, 368, 367, 370, 641–644, 217.1–217.17, 219, 221–225, 235, 238, 244–246, 249.01–249.04, 432, 457–458, 362/151–152, 369
See application file for complete search history.

(56) References Cited

U.S. PATENT DOCUMENTS

| | | | | | |
|---|---|---|---|---|---|
| 3,540,687 | A * | 11/1970 | Cuva | 248/223.41 |
| 4,713,734 | A * | 12/1987 | DeKay | 362/147 |
| 5,067,061 | A * | 11/1991 | Prickett | 362/145 |
| 5,307,254 | A * | 4/1994 | Russello et al. | 362/368 |
| 5,359,506 | A * | 10/1994 | Koleno | 362/248 |
| 5,813,641 | A * | 9/1998 | Baldwin | 248/223.41 |
| 5,893,628 | A * | 4/1999 | Byers | 362/396 |
| 6,773,140 | B2 * | 8/2004 | Lee | 362/249.16 |
| 7,100,624 | B2 * | 9/2006 | Lee | 135/16 |
| 7,455,427 | B1 * | 11/2008 | Freeman | 362/249.16 |
| 2007/0253222 | A1 * | 11/2007 | Driska et al. | 362/641 |

* cited by examiner

*Primary Examiner* — Robert May
(74) *Attorney, Agent, or Firm* — William E. Noonan

(57) ABSTRACT

A screen enclosure lighting system includes a housing mounted to the framework of the enclosure. The housing has a base for supporting a light source. The housing also includes a back portion attached to the base and supporting a top cover above the base. A curved window interconnects the base, the back portion and the top covering for projecting light from the light source through of an angle of approximately 180°. Exterior electrical wiring interconnects the light fixtures to an alternating current source.

17 Claims, 13 Drawing Sheets

SCREEN ENCLOSURE LIGHTING SYSTEM

RELATED APPLICATION

This application claims the benefit of U.S. Provisional Patent Application Ser. No. 61/279,431 filed Oct. 21, 2009.

FIELD OF THE INVENTION

This invention relates to a lighting system for screen enclosures of the type used in connection with outdoor patios, lanais and swimming pools. More particularly, the invention relates to an AC powered series of interconnected light fixtures that are mounted to respective vertical extrusions or beams of a screen enclosure.

BACKGROUND OF THE INVENTION

Screen enclosures are widely utilized for outdoor patios, lanais, swimming pools and the like. To date, it has been difficult to achieve satisfactory nighttime lighting within such enclosures. Wall and ceiling mounted lights are typically utilized for illuminating the area located within the screen enclosure proximate the house or other building to which the enclosure is attached. However, known lighting systems of this type usually do not adequately illuminate areas located at the outer perimeter of the enclosure. Spot lights or yard lighting are usually required for this purpose.

Recently, low voltage LED lighting has been attached to the overhead extrusions or beams of a screen enclosure. Installing such systems can be a time consuming, complicated and expensive process. Moreover, conventional LED lighting has been used largely to create entertaining and dramatic lighting effects, rather than for providing improved illumination of all areas within the screen enclosure. The known low voltage LED systems are limited to being mounted exclusively on the overhead extrusions and are not suitable for mounting on the vertical beams of the screen enclosure closer to the ground. There is currently a great need for a much more effective and easier to install lighting system for screen enclosures.

SUMMARY OF THE INVENTION

It is therefore an object of the present invention to provide a screen enclosure lighting system, which provides significantly improved illumination within all areas of a screen enclosure, including particularly the outer perimeter of the enclosure.

It is a further object of this invention to provide a screen enclosure lighting system that is extremely effective for use on outdoor patios and lanais and proximate swimming pools and which significantly improves the night time use and enjoyment of such areas.

It is a further object of this invention to provide a screen enclosure lighting system employing light fixtures that more effectively illuminate the interior of the enclosure, but which limit illumination outside of the enclosure.

It is a further object of this invention to provide a screen enclosure lighting system featuring fixtures that project light in a semi-circular pattern so that the light can be effectively directed throughout the interior of the enclosure rather than outside of the enclosure.

It is a further object of this invention to provide a screen enclosure lighting system that is relatively easy to install and that operates reliably for extended periods of time while requiring little or no maintenance.

It is a further object of this invention to provide a screen enclosure lighting system is unobtrusive and aesthetically attractive.

It is a further object of this invention to provide a screen enclosure lighting system featuring a very low profile construction that attaches quickly and conveniently to, and blends in with the horizontal and vertical extrusions of the screen enclosure.

It is a further object of this invention to provide a screen enclosure lighting system that does not require the wiring or lighting fixtures to be mounted to overhead beams and which is therefore much easier and less expensive to install and maintain and which provides for greatly improved, ground level lighting within the enclosure.

It is a further object of this invention to provide a screen enclosure lighting system that may be installed and operated without requiring any structural modifications to the enclosure.

It is a further object of this invention to provide a screen enclosure lighting system that operates effectively using conveniently available household alternating current.

It is a further object of this invention to provide a screen enclosure lighting system that allows the lighting to be operated and the lighting intensity within the enclosure to be adjusted remotely and conveniently.

It is a further object of this invention to provide a screen enclosure lighting system that meets all governmental building codes and which effectively encloses and conceals all wiring used in the system.

It is a further object of this invention to provide a screen enclosure lighting system that enables outdoor screen enclosures to be illuminated much more effectively and attractively than has been achieved with conventional lighting systems.

This invention results from a realization that the night time lighting within a screen enclosure can be improved considerably and effectively by fastening AC powered, inwardly directed light fixtures to respective vertical beams within the enclosure.

This invention features a screen enclosure lighting system that includes a plurality of interconnected lighting fixtures that are mounted to the screen enclosure. In particular, each light fixture includes a housing that is attachable to a respective vertical extrusion or beam of the screen enclosure. The housing includes a base for supporting a light source within the housing. The light source is electrically connected to a source of alternating current. More particularly, the light source is interconnected to the alternating current power source by wiring that extends through a conduit mounted interiorly to an inside surface of the screen enclosure. The conduit encloses the wiring and obscures such wiring from view so that the system complies with governmental building codes and regulations. Alternating current is provided through the wiring to the light source, which emits illuminating light through a window of the housing and into the screen enclosure.

In a preferred embodiment, the housing features a modular construction. The light source may include a light bulb that is operatively receivable in an electrical receptacle formed in the base. The electrical receptacle is, in turn, electrically connected to the wiring. The housing may carry an electrical socket that is operatively engagable with a corresponding plug attached to an end of the wiring. In such versions, an internal fixture wiring segment may electrically interconnect the plug with the receptacle so that alternating current power is provided from the wiring to a light source mounted in the receptacle.

The housing may feature a modular construction, which includes the base and a back section connectable to the base. A cover may be releasably attached to the back section and spaced above the base. The window may be interconnected between the base and the cover. The base, window and cover may include respective corresponding curved configurations such that the sides of the window are connected to the back section of the housing. Typically, the window configured in this manner projects light from the light source through an angle of approximately 180°. As a result, light from the light source is projected largely into the interior of the enclosure to which the housing is attached rather than exteriorly of the enclosure.

The back section may include an opening through which the socket is mounted. The back section may further carry one or more mounting clips that selectively engage and attach to a respective vertical extrusion or beam of the enclosure for supporting the housing thereon.

The conduit may be attachable to inwardly facing surfaces of horizontal and vertical extrusions forming the screen enclosure. The conduit may have a semi-circular configuration and comprise a color that matches the color of the screen enclosure beams. Typically, the conduit is secured to the extrusions or beams of the enclosure by adhesive means such as double-sided tape. In certain versions, the conduit may include a substantially flat bottom surface that flushly engages an inwardly facing surface of a corresponding extrusion. The double-sided tape or other adhesive means are interposed between the bottom surface of the conduit and the inwardly facing surface of the extrusion to facilitate attachment of the conduit to the extrusion. In alternative embodiments, the conduit may include an inner channel for accommodating the wiring and a pair of wings that extend from the channel. Tape or other forms of adhesion may be used to interconnect the wings to the inside surface of a corresponding extrusion in order to mount this type of conduit to the screen enclosure.

Preferably, each housing is supported above the conduits through which the wiring extends. Under no circumstances is the conduit mounted to overhead extrusions or beams of the enclosure. Rather, mounting of the conduits is limited to the vertical extrusions to which the housing are attached and underlying horizontal extrusions of the screen enclosure.

A remote control system may be utilized for turning on and off the light sources and for selectively dimming and brightening the light sources. The remote control system may include a control panel for selectively generating on/off and intensity adjustment signals. The control panel may have a wireless transmitter that directs the signals to a corresponding wireless receiver plugged into the electrical system including the wiring that electrically interconnects the AC power source to the light sources of the lighting system. A control module is electrically interconnected to the wiring for receiving selected control signals from the receiver. The control module thereby controls the electrical power supply through the wiring to turn the light sources on and off and to control the light intensity projected by the light source.

DETAILED DESCRIPTION OF PREFERRED EMBODIMENTS

Other objects, features and advantages will occur from the following description of a preferred embodiment and the accompanying drawings, in which.

Figure 1:
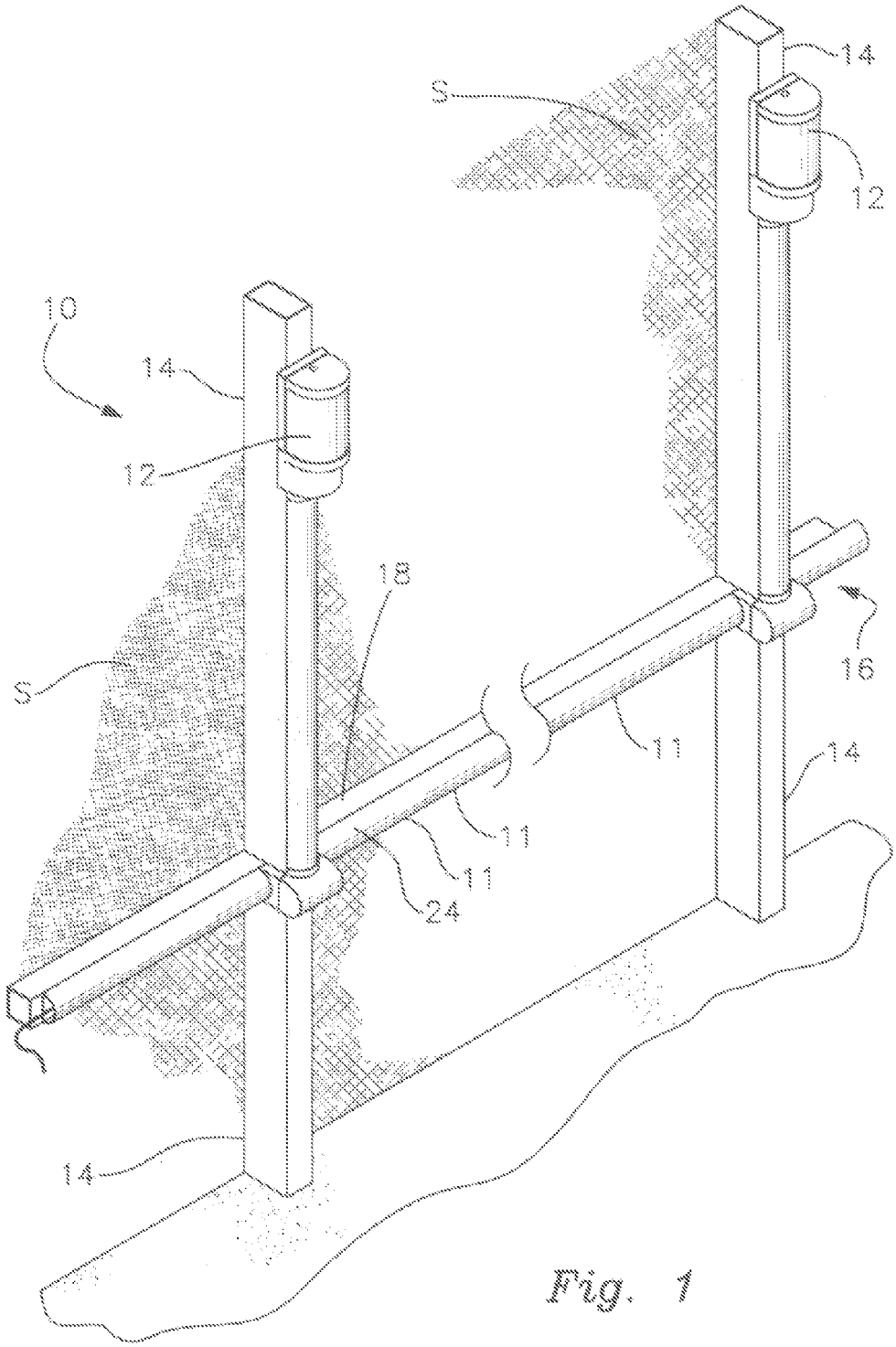
FIG. 1 is a fragmentary perspective view of the screen enclosure lighting system of this invention and particularly depicting a pair of light fixtures used in the system.
Figure 2:
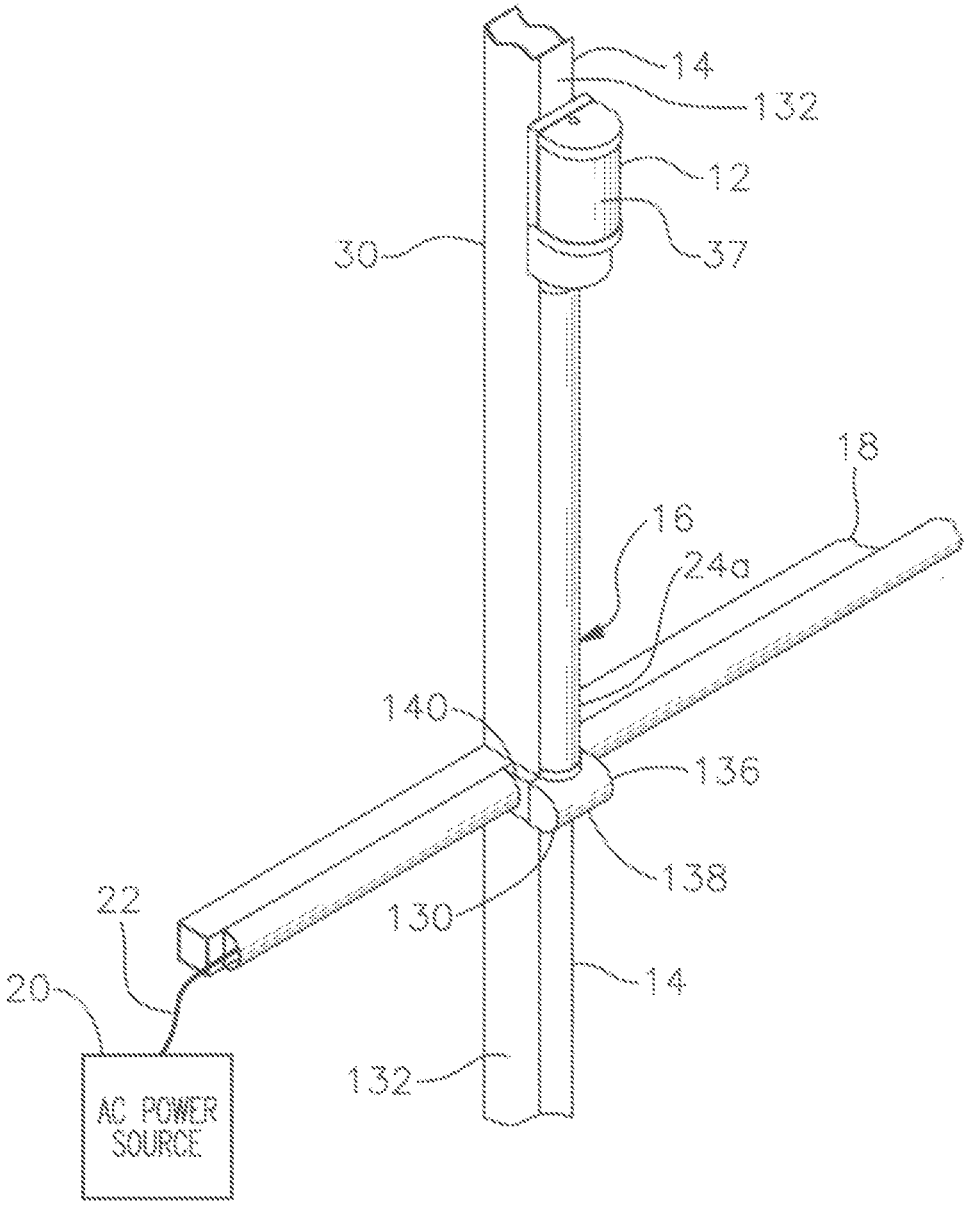
FIG. 2 is a fragmentary perspective and mostly schematic view of the lighting system with a single representative lighting fixture used in the lighting system, as well as the wire accommodating conduit connected thereto.

There is shown in FIGS. 1 and 2 a screen enclosure lighting system 10 featuring a plurality of light fixtures 12 mounted to respective vertical frame components, beams or extrusions 14 of screen enclosure 16. It should be understood that lighting system 10 may be utilized for various types of screen enclosures including, but not limited to, enclosures used for covering outdoor patios, lanais, swimming pools, etc. The particular application to which the screen enclosure is used is not a limitation of this invention. Typically, enclosure 16 comprises a skeletal framework 11 that supports a screen S. The framework is constructed of vertical extrusions 14 and interconnected horizontal extrusions 18, which are composed of aluminum and/or various other metals/metal alloys. It should also be understood that most, if not all, screen enclosures also include a plurality of overhead extrusions which, as used herein, refer to either inclined or horizontal beams that interconnect either a pair of vertical extrusions located on opposite sides of the enclosed area or a vertical extrusion and the house or other building to which the enclosure is attached. Such overhead beams or extrusions, which are not shown herein, are not utilized by the lighting system of this invention. It should also be understood that the manner of constructing the screen enclosure and securing the screen thereto is well known and does not constitute a feature of this invention. Indeed, lighting system 10 may be effectively and conveniently retrofit onto virtually all existing screen enclosures.

A plurality of light fixtures 12 are mounted to respective vertical beams 14. Any multiple number of fixtures 12 may be utilized within the scope of this invention. As represented schematically in FIG. 2, each fixture 12 is electrically interconnected to an AC power source 20 by electrical wiring 22 that is run through a conduit 24 mounted to the inwardly facing surfaces of the beams of enclosure 16. FIG. 1 best shows wire accommodating conduit 24 extending along beams 14 and 18 between adjacent light fixtures 12. The specific preferred manner in which conduit 24 is mounted to the beams is described more fully below.

A representative light fixture 12 is depicted alone in FIGS. 3-6. Fixture 12 includes a modular housing 30 that is typically formed of a molded plastic material. Metals and metal alloys may alternatively be employed. More particularly, housing 30 includes a lower base 32, a back piece 34 that is engaged with and extends upwardly from base 32, and a cover piece 35 that is attached to an upper end of back piece 34. The cover piece is thereby spaced above the base. A convex transparent or translucent window 37 extends upwardly from base 32 to cover piece 35. The side edges 39 and 41 of window 37 are interengaged with back piece 34. Various types of translucent or transparent materials including plastics and glass may be utilized for window 37. The window may have a smooth, transparent texture as shown in FIGS. 3-6. Alternatively, it may include a textured, translucent appearance as depicted in FIGS. 1 and 2.

Base 32, back piece 34, cover piece 35 and window 37 define an interior compartment 43 for accommodating a light source 72. Typically, the light source comprises an incandescent bulb suitable for providing outdoor illumination. The type, configuration and intensity of the bulb may be varied within the scope of this invention. An assortment of light sources may be utilized, which will be known to persons skilled in the art. Bulb 72 is operatively supported in a standard electrical receptacle 74, which is mounted to base 32 such that is supports bulb 72 within compartment 43 of housing 30. The details of this construction are described more fully below.

Figure 5:
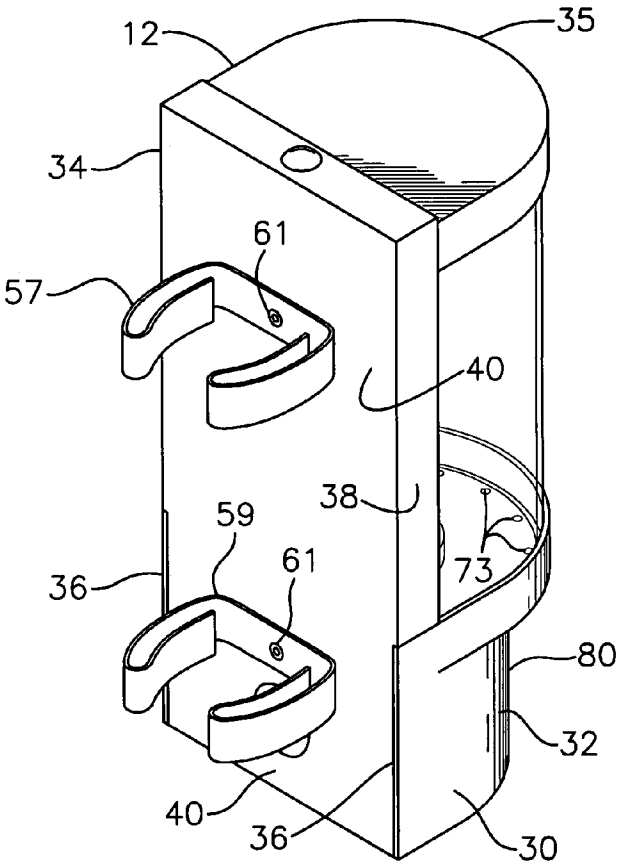
FIG. 5 is a rear perspective view of the preferred fixture with the mounting brackets attached thereto.
Figure 6:
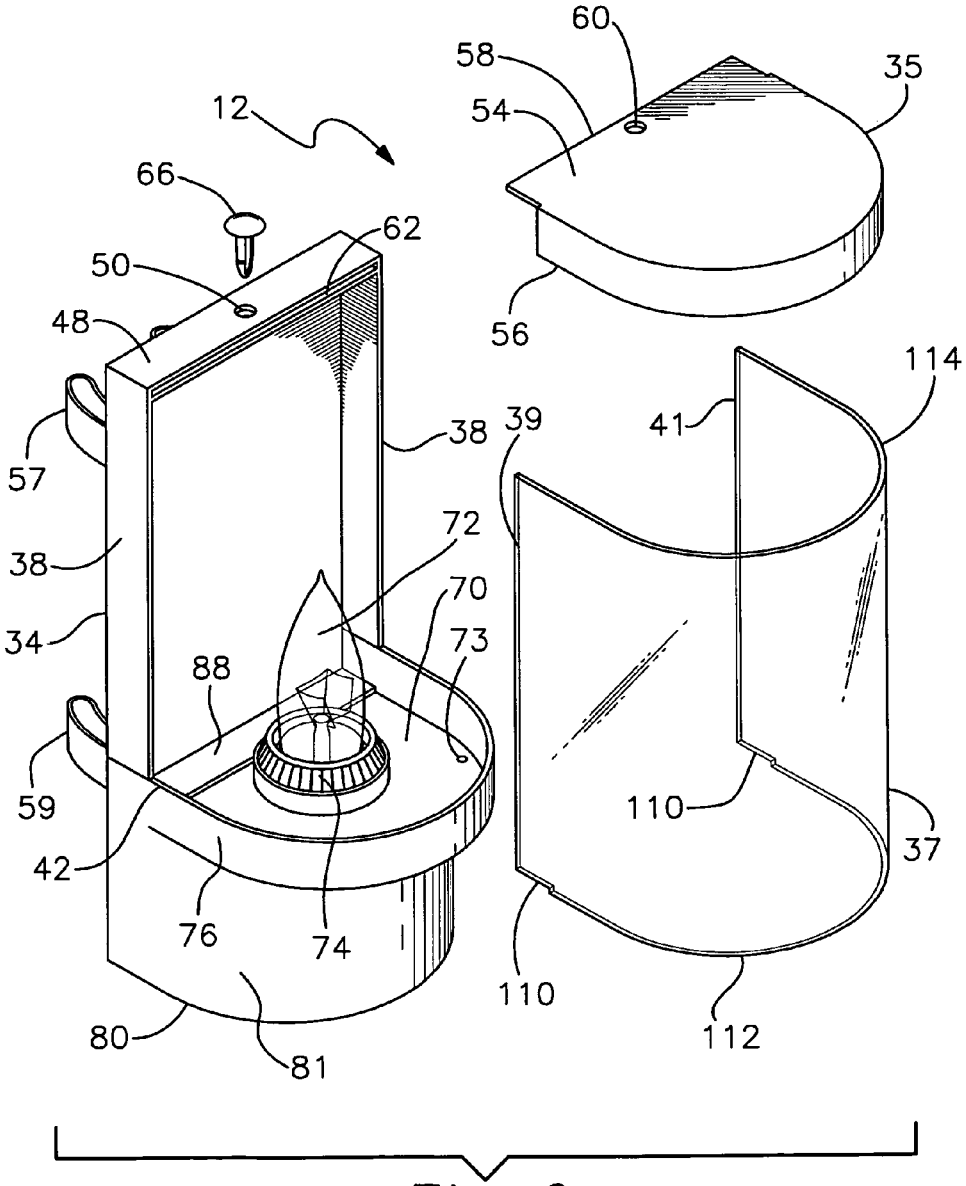
FIG. 6 is an exploded front view of the preferred lighting fixture.
Figure 7A:
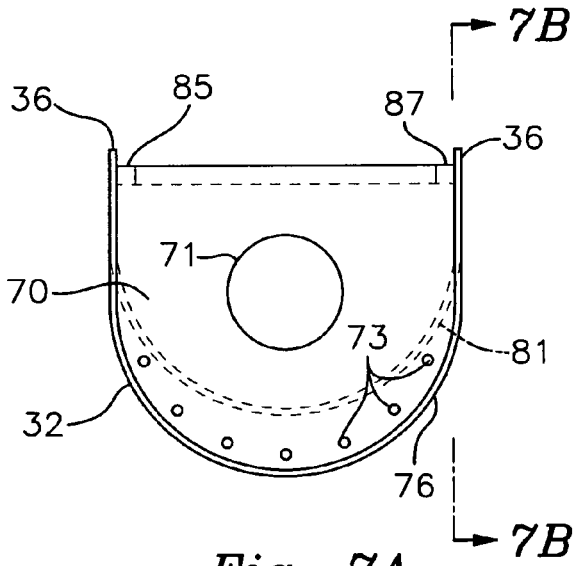
FIG. 7A is a top plan view of the base of the fixture housing.
Figure 7B:
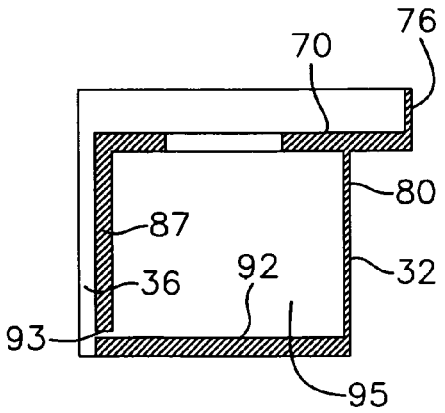
FIG. 7B is a side cross section view of the base.
Figure 7C:
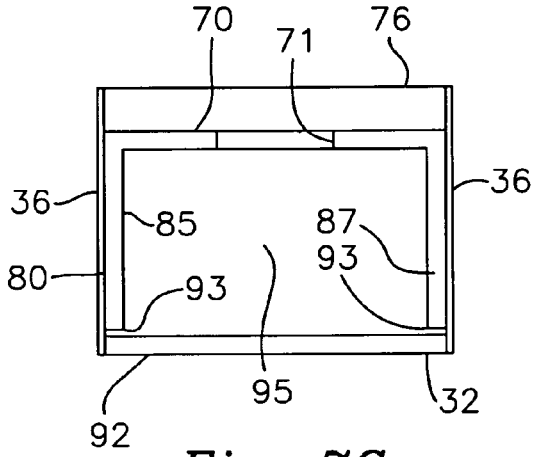
FIG. 7C is an elevational rear view of the base.

Base 32 is depicted individually in FIGS. 7A-7C. In particular, the base includes an upper platform 70 that is bounded by a convex, upwardly turned lip 76. Platform 70 includes a central opening 71 for accommodating light bulb 72 and receptacle 74 (FIGS. 3-6). In addition, the platform includes a series of small holes 73, FIGS. 3-6 and 7A, which allow water that has accumulated within compartment 43 to drain from the base.

Base 32 also includes a lower enclosure 80 defined by a convexly curved forward wall 81. See FIGS. 3, 6 and 7A. Wall 81 is attached unitarily to platform 70. A pair of inwardly turned vertical rails 85, 87 extend inwardly from respective opposing sides of wall 81 proximate rearward ends of the walls. Rails 85 and 87 are likewise unitarily connected to platform 70 as best shown in FIGS. 7B and 7C. As a result, wall 81 terminates in a pair of rearward vertical lips 36 that extend rearwardly of inwardly turned rails 85 and 87.

Enclosure 80 further includes a substantially flat floor 92 (FIGS. 7B and 7C) that is unitarily molded with curved wall 81. The lower ends of rails 85 and 87 are spaced above floor 92 to provide gaps 93, which facilitate interconnection of the base to the back piece in a manner described more fully below. Enclosure 80 of base 32 defines an interior cavity 95 that accommodates electrical components of the system as described more fully below.

Figure 8A:
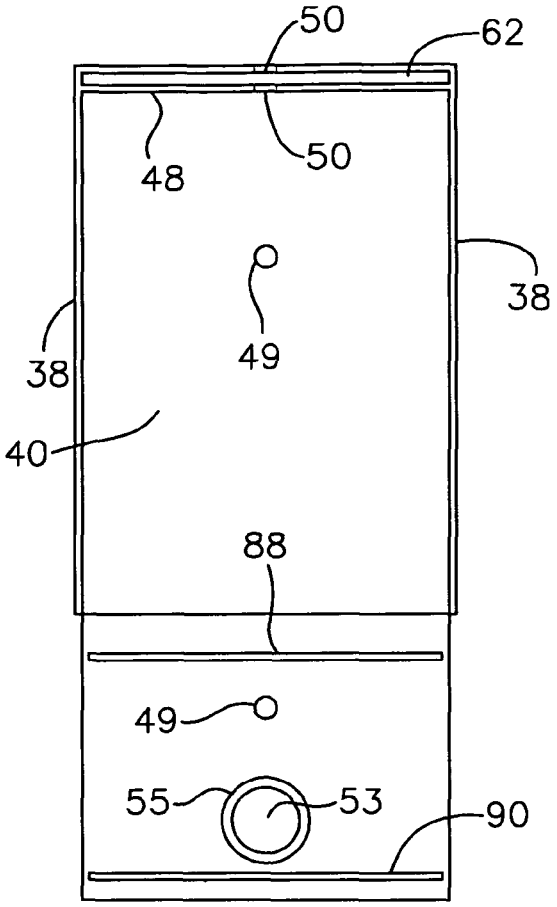
FIG. 8A is a top plan view of the back section of the fixture housing.
Figure 8B:
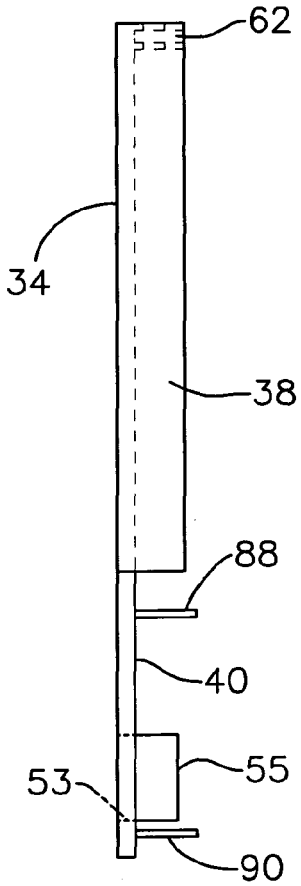
FIG. 8B is a side elevation view of the back section.
Figure 8C:
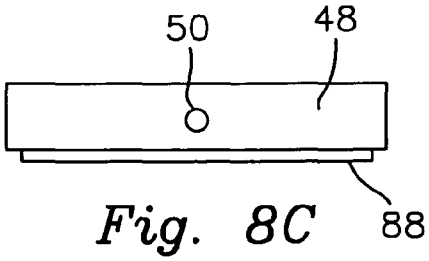
FIG. 8C is a front elevation view of the back section.

Back piece 34 is illustrated by itself in FIGS. 8A-8C. The back piece includes a flat rectangular panel 40. Vertical side edges of panel 40 are bounded by forwardly turned lips 38, at least along the upper portions of those side edges. The lower portions of the side edges do not include forwardly turned lips. The upper horizontal edge of panel 40 carries an integral insertion slot 62 that is defined by a parallel pair of forwardly extending lips 48. Lips 48 include respective aligned connector holes 50 formed centrally therein.

Back panel 40 likewise includes a pair of connector holes 49, which are interengagable with rivets or other fasteners for securing brackets to the back piece in a manner described more fully below. In particular, as best illustrated in FIG. 5, a pair of extrusion engaging spring clips 57 and 59 are fastened to back panel 40 by means of respective rivets 61 that are engaged to respective holes 49. Alternative forms of connectors may be utilized. Back panel 40 carries a pair of forwardly extending ribs 88 and 90 that extend horizontally across a lower portion of back panel 40. Ribs 88 and 90 are oriented such that they are substantially parallel to one another.

Figure 9A:
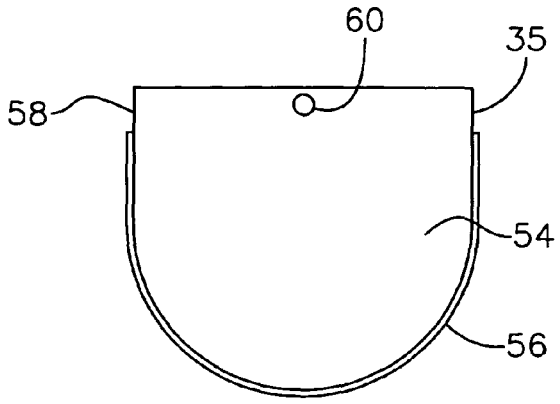
FIG. 9A is a top plan view of the cover of the fixture housing.
Figure 9B:
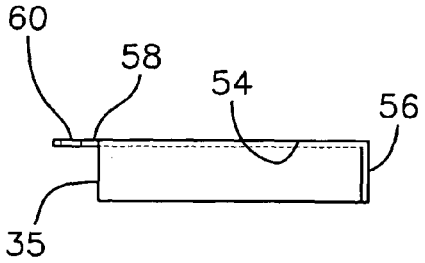
FIG. 9B is an elevational side view of the cover.
Figure 9C:
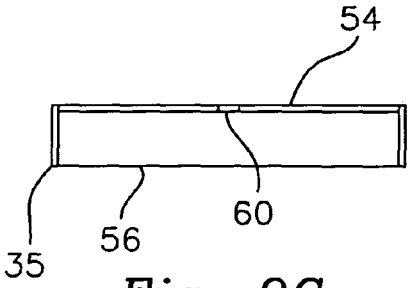
FIG. 9C is an elevational rear view of the cover.

Top cover piece 35 is shown alone in FIGS. 9A-9C. The top cover includes a flat panel 54 having a convex forward end from which a convex downwardly turned lip 56 integrally hangs. Panel 54 also includes a rearwardly extending insertion tab 58 that extends beyond the rearward ends of lip 56. A connector hole 60, which corresponds to holes 50 in back piece 34, is formed centrally in insertion tab 58. A larger hole 53 is formed proximate the lower end of panel 40. This hole communicates with a bushing 55 that holds an electrical connector for operatively attaching fixture 12 to the exterior wiring in the manner shown more fully below.

Each of the respective pieces, namely base 32, back piece 34 and top cover 35 are formed integrally by a suitable manufacturing process such as molding. It should be understood that these pieces may feature alternative constructions and configurations within the scope of this invention. Indeed, in certain embodiments the individual parts of the housing, as described herein, may themselves be joined integrally.

Figure 4:
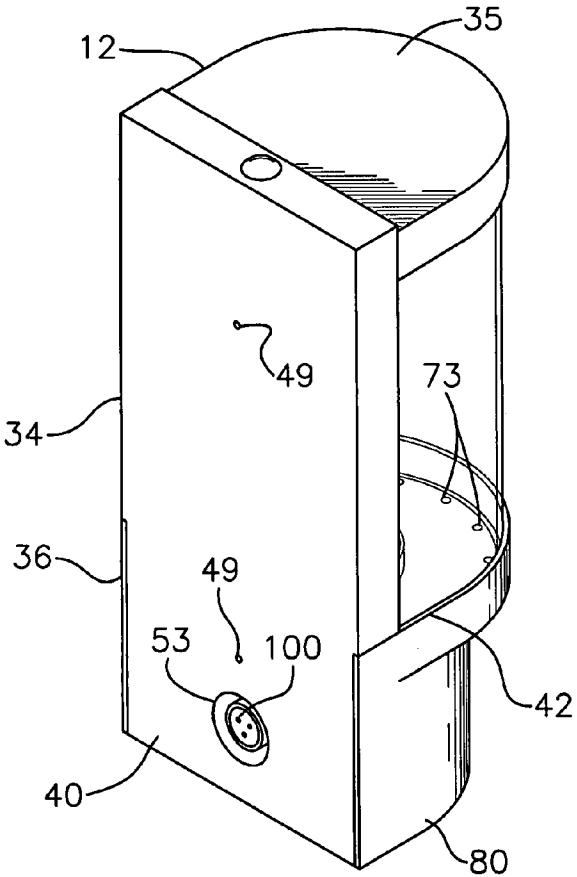
FIG. 4 is a perspective rear view of the preferred fixture without mounting brackets attached thereto.
Figure 10:
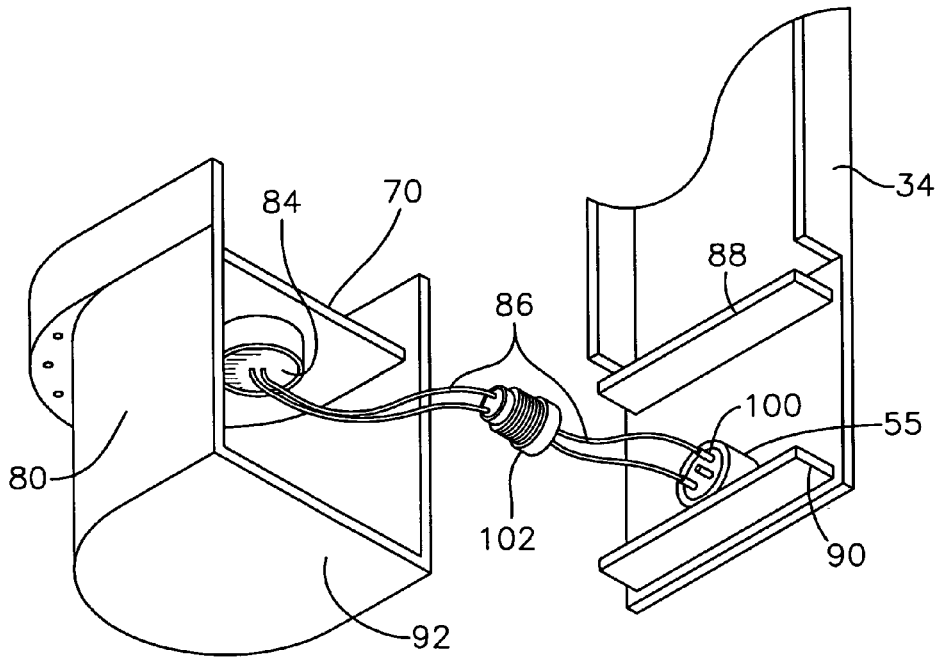
FIG. 10 is a perspective view of the base and the back section separated from one another to reveal the internal wiring that interconnects the socket to the light source receptacle.
Figure 11:
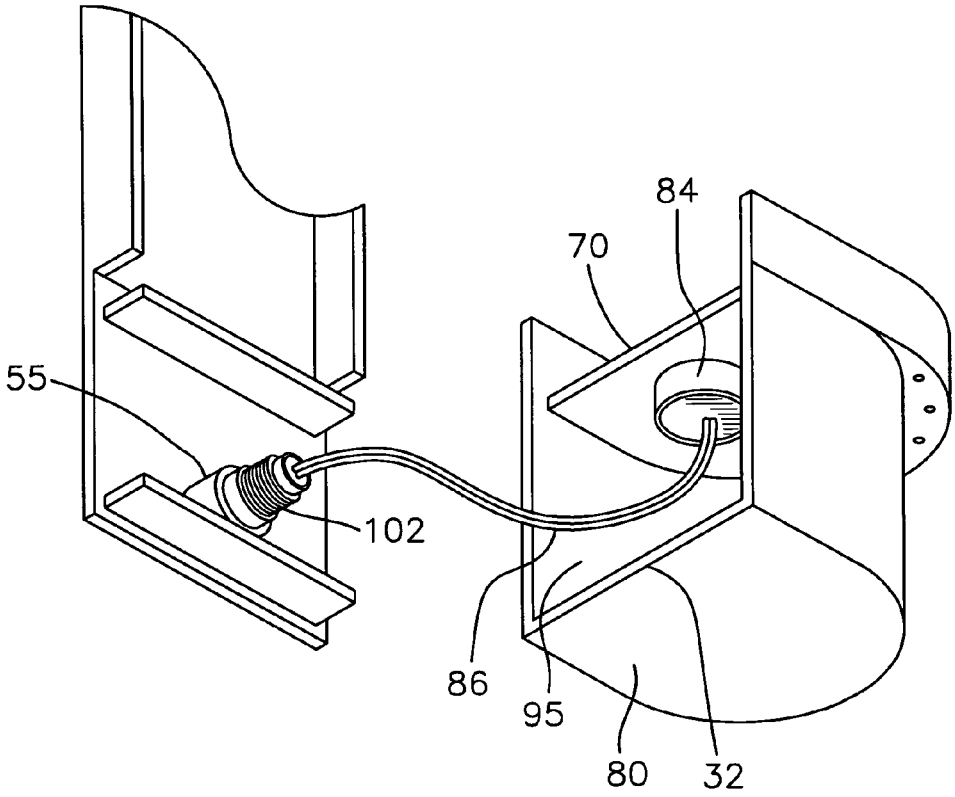
FIG. 11 is another perspective view of the base and back section separated to show the internal fixture wiring and with an electrical cap engaged with the socket.

As shown in FIGS. 10 and 11, a conventional electrical connector base 84 is mounted within cavity 95 of enclosure 80. More particularly, base 84 is joined in a conventional manner to an electric receptacle 74 supported upon platform 70. Receptacle 74 and attached base 84 will be well known to persons skilled in the art. Base 84 is electrically connected by internal fixture wiring 86 to the contacts of an electrical socket 100 (FIGS. 4 and 10) which is mounted within bushing 55 of back piece 34. A standard electrical cap 102, FIGS. 10 and 11, covers the contents of socket 100 and accommodates the internal wiring 86 therethrough. As depicted in FIG. 4, a preferred type of socket is a three pin socket capable of receiving a Cannon™ type electrical plug used by the exterior wiring 22 (FIG. 2). It should be understood that various alternative types of electrical interconnection may be utilized between the fixture wiring 86 and the external wiring 22 in accordance with this invention. In some cases, the light source base 84 may be hard wired to the external wiring. Releasable plugs or other types of connectors are preferred, however, so that the individual fixtures may be conveniently replaced or repaired as needed or desired.

Figure 3:
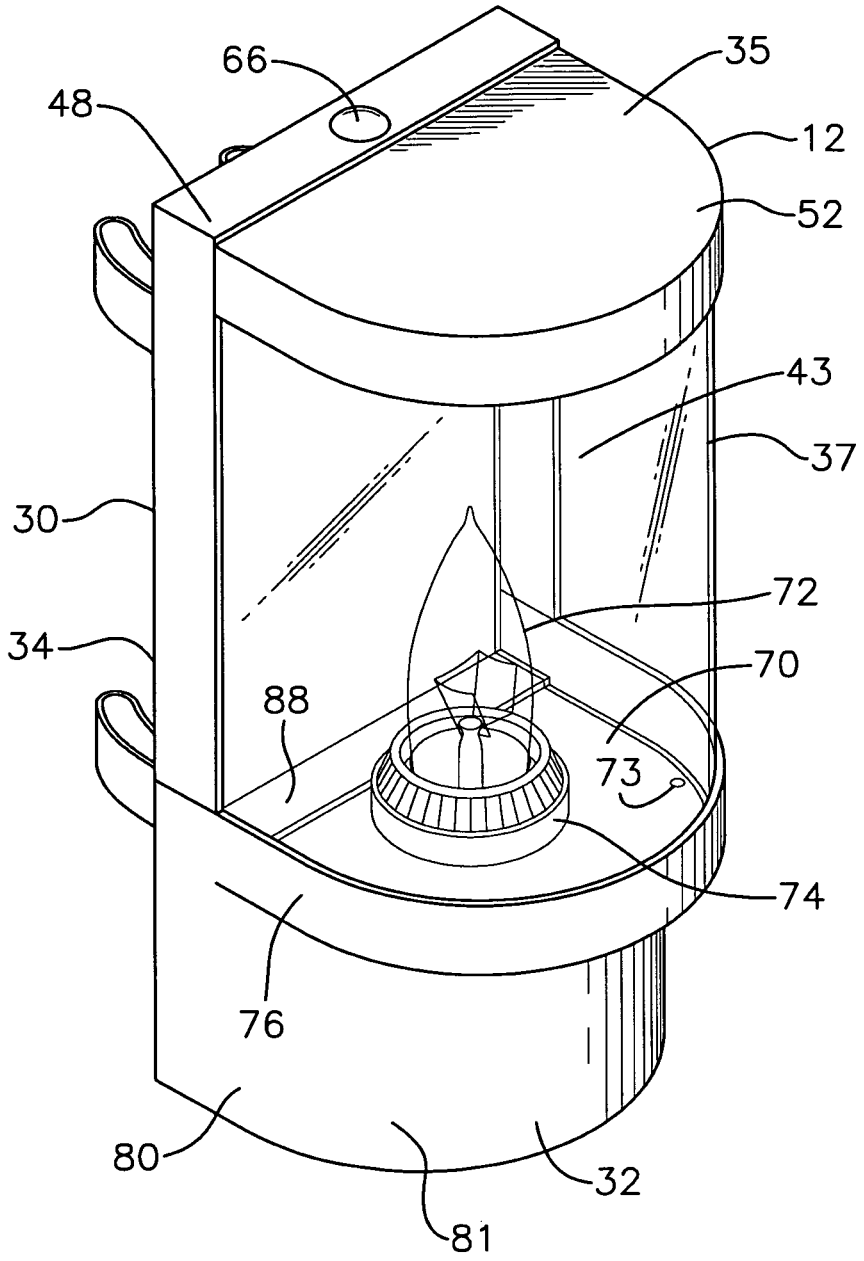
FIG. 3 is a perspective front view of the preferred lighting fixture used in the system.

The individual components of each fixture, namely base 32, back piece 34, top cover 35 and window 37 are assembled in the manner shown in FIGS. 3-6. In particular, back piece 34 is interengaged with base 32. Rib 88 engages the upper surface of platform 70 (FIGS. 3 and 6). Lower rib 90 (FIGS. 8A and 8B) is received by gaps 93 in base 32 (FIG. 7C). As best shown in FIGS. 4 and 5, the lower end of back panel 40 flushly interengages the back of the back extension edges 36 of base 32. The inside lower surface of panel 40 abuts inwardly turned rails 85 and 87 of the base. The forwardly turned side lips 38 of piece 34 engage the upper edge 42 of arcuate lip 76 at their respective lower ends and extend upwardly therefrom.

Top cover 35 is interengaged with back piece 34 by introducing insertion tab 58 into horizontal slot 62. This aligns connector holes 50 and 60 so that a pin 66 (FIGS. 3-6) may be introduced through the aligned holes to attach the top cover to the back piece. Assembly of the housing is completed by interengaging window 37 with the remaining molded components. Typically, the window may be installed into the assembled base and back piece as shown in FIG. 6 and prior to attachment of the top cover. The vertical side edges 39 and 41 of window 37 are fit within the respective side lips 38 of back piece 34. The window includes a pair of notches 110 proximate its respective ends, which accommodate rib 88. The window has a lower arcuate edge 112 that generally conforms to arcuate lip 76 of base 32. By the same token, the window has a similarly curved upper edge 114 that conforms to the shape of lip 56 of top cover 35. When the components are fully assembled, fixture 12 appears in the manner best shown in FIG. 3 and further shown in FIGS. 1 and 2. The previously described electrical components shown in FIGS. 10 and 11 are accommodated within the enclosed cavity of base 32.

Each of the fixtures described above is securely and attractively mounted to a respective vertical frame component 14 in the manner shown in FIGS. 1 and 2. In particular, each fixture 12 is positioned at a desired height along a respective beam 14 such that panel 40 of back piece 34 is juxtaposed against an inside facing surface 132 of frame component 14. The fixture is then pressed against the extrusion such that the arms of spring clips 57 and 59 resiliently open and grip the extrusion. This holds the fixture securely onto extrusion component 14. The window 37 is oriented such that the fixture is able to provide effective light projection of approximately 180° to the inside of the screen enclosure.

Figure 12:
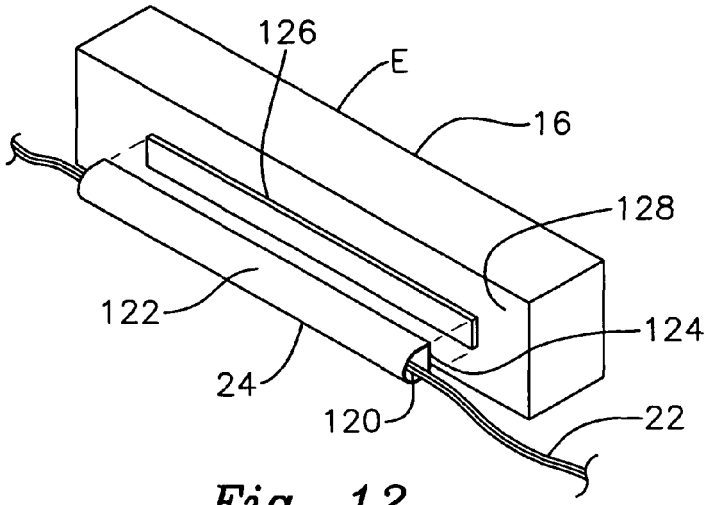
FIG. 12 is a perspective exploded view of a preferred conduit for accommodating the wiring and further depicting a double-sided tape for securing the conduit to an inside surface of an extrusion of the enclosure.

As shown in FIGS. 1 and 2, wiring 22 is run through an enclosed conduit 24 between a conventional household AC power source 20 and each fixture 12 in system 10. As depicted in FIG. 12, conduit 24 may include one or more elongate pieces of plastic having a semi-circular or other cross sectionally configured channel 120 through which wiring 22 extends. Conduit 24 particularly includes a curved or semicircular portion 122 that presents a smooth and aesthetically attractive appearance, as well as a flat inner surface 124 for flushly engaging an inwardly facing beam surface. Means of attachment such as double-sided tape 126 or alternative adhesive means are used to interconnected and solidly join the outer surface of flat side 122 with the inwardly facing surface 128 of screen enclosure extrusion E. It should be understood the extrusion E may comprise either a vertical extrusion 14 or a horizontal extrusion 18 as depicted in FIGS. 1 and 2. It is quite important that the conduit be firmly secured to an inside facing surfaces of the enclosure frame so that an attractive and unobtrusive profile and appearance are provided. Preferably, the color of the conduit should match that of the extrusion.

Figure 2A:
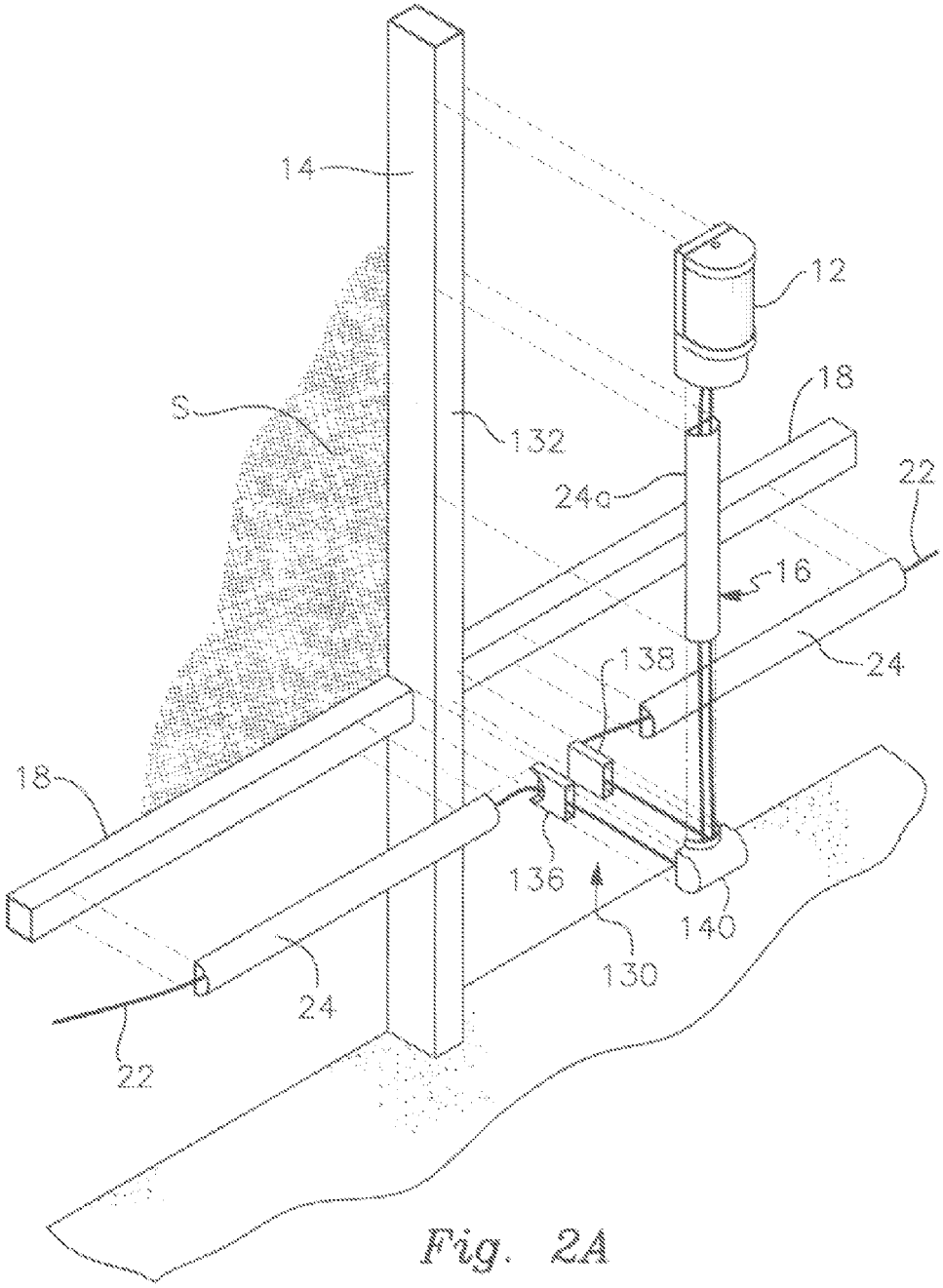
FIG. 2A is an exploded view of the single representative fixture and conduit depicted in FIG. 2.

The conduit 24 is configured as required to provide the shortest possible path between each fixture 12 in the lighting system. As shown in FIGS. 1, and 2A, exterior wiring 22 extends along horizontal extrusion or frame components 18. When a conduit reaches a vertical frame component 14, the conduit is communicably joined to jutting conduit portion section 130 comprising three short, communicably interconnected conduit segments that effectively wrap about the opposing left-hand and right-hand sides of vertical frame component 14, as well as the inside surface 132 of that frame component. More particularly, jutting conduit section 130 includes three perpendicularly interconnected segments 136, 138 and 140 that are adhesively secured to the opposing sides and inside surface respectively of extrusion component 14. Each of the short segments has a flat surface that engages a respective surface of the extrusion and is secured thereto to by double-sided tape or other means as described above. A vertical segment 24*a* of conduit 24 is communicably joined to conduit section 130 by appropriately cutting and trimming the respective conduit segments. Wiring is then connected from conduit 24 such that it extends through jutting conduit segment section 130 and upwardly through conduit section 24*a* to light fixture 12. The wiring exits the conduit proximate the bottom surface of base 32 and extends between housing 30 and the inwardly facing surface 132 of extrusion 14. A plug carried by the end of the wiring is connected to socket 100 (FIGS. 4 and 10) such that the fixture 12 is electrically connected to the AC power source.

Figure 13:
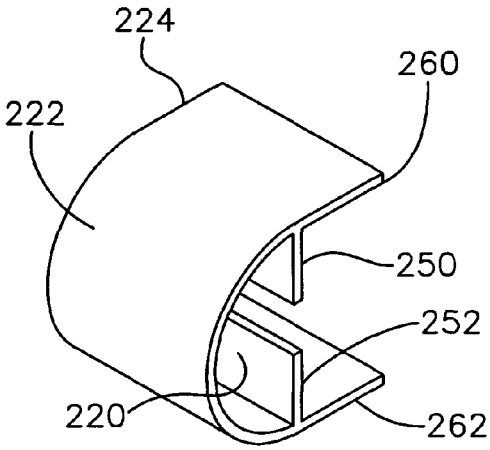
FIG. 13 is a perspective view of a small segment of an alternative conduit that may be used for accommodating the wiring.
Figure 14:
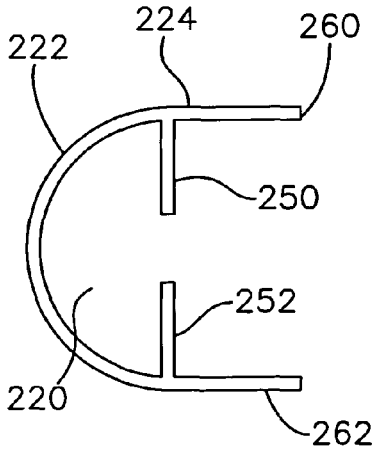
FIG. 14 is an elevational end view of the conduit segment shown in FIGS. 12 and 13.

A wide variety of alternative conduit configurations may be employed within the scope of this invention. For example, as shown in FIGS. 13 and 14, each section of conduit 224 may include an arcuate profile 222 and a pair of opposing flanges 250, 252 that define an interior channel 220 for accommodating the exterior wiring of the lighting system. Upper and lower legs or wings 260 and 262 extend from flanges 250 and 252 respectively. Tape, double-sided tape or some other adhesive may be received between the wings and employed to secure a conduit having this type of configuration to the surfaces of the extrusion in a manner analogous to that previously described.

In operation, a plurality of fixtures 12, as previously described, are mounted to respective vertical extrusions components by clips 57, 59 or other forms of attachment (e.g. screws, magnetic means, hangers, brackets, etc.). Wiring is then run through the conduits so that the wiring is obscured in an aesthetically attractive manner. Various alternative conduit configurations may be employed in addition to the representative conduits shown herein. The fixtures are placed interiorly within the screen enclosure and are directed so that improved illumination is provided within the enclosure. The use of an arcuate profile of approximately 180° directs the majority of the illumination effectively toward the inside of the enclosure rather than exteriorly of the enclosure where conventional yard lighting is better suited to provide illumination.

Figure 15:
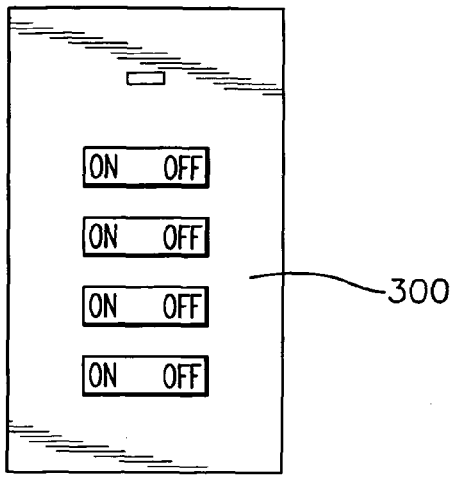
FIG. 15 depicts a wall mounted panel for remotely controlling the lighting system.
Figure 16:
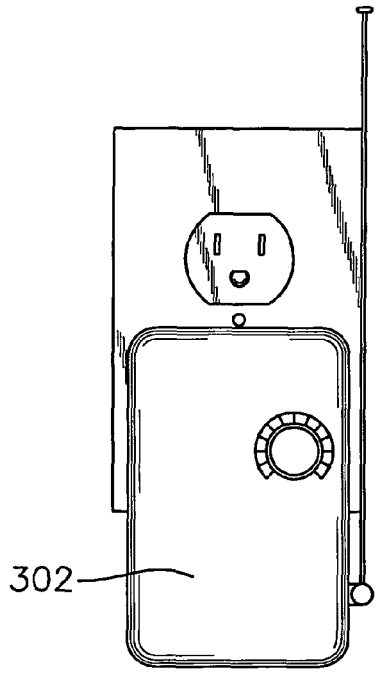
FIG. 16 depicts a plug-in receiver that receives control signals from the panel shown in FIG. 15.
Figure 17:
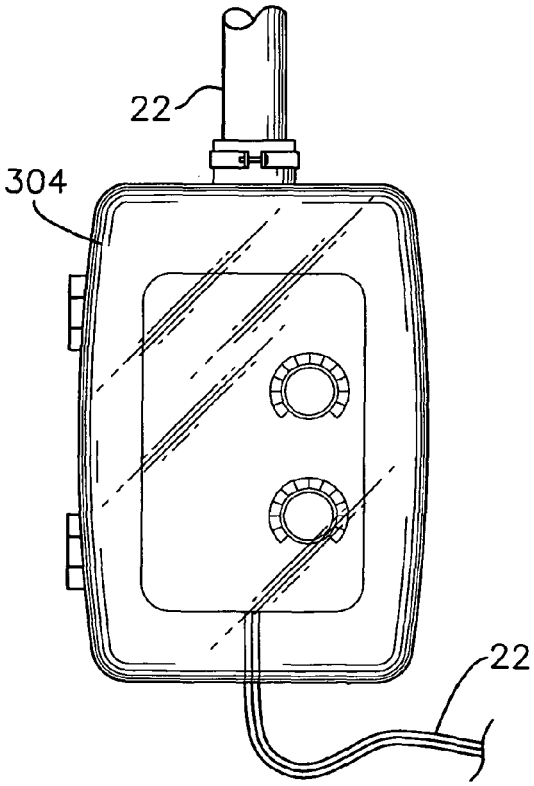
FIG. 17 is a perspective view of a control module that is operated by signals transmitted from the receiver to control the lighting system remotely in accordance with this invention.

The lighting system can be effectively operated in a remote manner by employing components shown in FIGS. 15-17. In particular, a control panel 300, FIG. 15, which may be either wall mounted or portable, may be utilized to transmit a control signal for selectively turning the lights of the lighting system on or off or for alternatively dimming or brightening the lights as required. This signal is received by the antenna of a receiver unit 302, FIG. 16, which is plugged into a standard household outlet. In response to the transmitted control signal, receiver 302 provides an appropriate signal to a control module 304, FIG. 17 that is interconnected between the AC power source and light fixtures 12. Module 304 is more specifically interconnected to wiring 22 of the system. Control module 304 responds to signals from receiver 302 and thereby directs the lights within the system to turn on or off or to brighten/dim as directed. It should be understood that various remote systems such as the Power House X10™ system may be employed within the scope of this invention.

In certain embodiments, the system may be fully portable. The wire accommodating conduit may be releasably secured to the enclosure beams by brackets or other means that allow the conduit to be removed and re-installed in another enclosure. Preferably the wire is plugged into a readily accessible GFI receptacle so that portability is further facilitated and the need to comply with building code requirements is likely avoided. A conventional AC plug to power the system also simplifies installation and allows the homeowner to install the system virtually as easily as a professional installer. Powering the lighting system in this way also allows the system to be conveniently removed in the event of an impending hurricane or other natural disaster.

Accordingly, the present invention provides for an attractive manner for effectively lighting the interior of a pool enclosure. Assembly and installation are quick and convenient. The fixtures are mounted to vertical beams preferably no higher than 7'-10' above ground level. Under no circumstances are fixtures mounted to overhead beams of the enclosure. Household alternating current power is employed and the use of incandescent lighting is especially preferred. Thereby, effective lighting is achieved even in the perimeter regions of the area enclosed by the screen enclosure. Lighting is improved still more by utilizing the unique 180° light projecting profile that directs most, if not all, of the illumination effectively toward the interior of the enclosure.

In still other alternative versions of this invention, the lighting fixture may be powered by a solar cell that is either built into the housing or comprises a solar panel mounted to the extrusion or otherwise in the vicinity of the lanai or enclosure. A rechargeable battery may be operably connected to the light fixture and disposed within the base on the housing. A solar cell may be clipped onto the enclosure adjacent to the light fixture or otherwise mounted in the vicinity of the light fixture. In such cases, the cell may be connected by conventional wiring to the battery.

It should be understood that the individual components of the light fixture including the housing, the extrusion engaging clips and the wire accommodating conduit may be composed of various plastics suited for outdoor use. Alternatively, aluminum and other metals and metal alloys may be employed.

From the foregoing it may be seen that the apparatus of this invention provides for a lighting for screen enclosures of the type used with outdoor patios, lanais and swimming pools. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Although specific features of the invention are shown in some of the drawings and not others, this is for convenience only, as each feature may be combined with any and all of the other features in accordance with this invention.

Other embodiments will occur to those skilled in the art and are within the following claims.

What is claimed is:

1. A screen enclosure lighting system comprising:

a screen enclosure that has a skeletal framework including a plurality of interconnected horizontal and vertical beams supporting a screen thereon;

a plurality of lighting fixtures mounted on said framework, each said fixture including a housing that is attached to a respective vertical beam of said framework and abuts an outer surface of said beam facing an interior of said enclosure, said housing including a base for supporting a light source within said housing, said light source being electrically connected by electrical wiring to a source of electrical power to illuminate said light source, said housing further including a window directed toward an interior of said enclosure to transmit light from said illuminated light source toward said interior of said enclosure; and a conduit mounted on outer surfaces of said beams, which conduit accommodates and hides at least a portion of said wiring between said source of the electrical power and said light source, said conduit including vertical conduit segments mounted to and extending along respective vertical beams of said framework and horizontal conduit segments mounted to and extending along respective horizontal beams of said framework, said conduit including a jutting conduit section communicably connecting a pair of horizontal conduit segments extending along respective horizontal beams to a vertical conduit segment extending along a vertical beam that is intermediate said respective horizontal beams.

2. The system of claim 1 in which said light source includes a bulb that is operatively received by an electrical receptacle carried by said base;

said base carrying means for electrically interconnecting said electrical receptacle to said wiring.

3. The system of claim 2 in which said base includes an electrical socket for receiving a complementary electrical plug carried by said wiring.

4. The system of claim 2 in which said housing further includes a back section connectable to said base.

5. The system of claim 4 in which said back section of said housing carries a mounting clip for releasably engaging said skeletal framework to support said lighting fixture thereon, each said vertical beam having a rectangular cross sectional configuration and a substantially planar interiorly facing surface, said mounting clip including a spaced apart pair of spring arms with a substantially planar surface extending between said spring arms for flushly engaging said inwardly facing surface of a respective said vertical beam.

6. The system of claim 4 in which said housing further includes a cover attached releasably to said back section and spaced above said base.

7. The system of claim 6 in which said window is interconnected between said base and said cover.

8. The system of claim 6 in which said base, window and cover include respective corresponding curved configurations, such that said window is contiguous with said back section of said housing.

9. The system of claim 1 in which said conduit has a semicircular cross sectional configuration; said conduit including a flat base for flushly interengaging a flat interior surface of said skeletal framework.

10. The system of claim 9 further including an adhesive interposed between said flat base and an interiorly facing surface of a corresponding beam of said enclosure for securing said conduit to said beam.

11. The system of claim 1 in which said housing is mounted to said skeletal framework above said conduit.

12. The system of claim 1 further including a remote control assembly for selectively connecting the power source to said light source and regulating the level of power provided to said light source; said remote control assembly including a controller for selectively generating on/off and intensity adjustment signals, said controller including a transmitter for directing said signals to a receiver connected to said wiring, said remote control assembly further including a control module electrically connected and responsive to said receiver for regulating the current delivered to said light sources and selectively turning on and off said light sources and controlling the intensity of light projected by said light sources.

13. The system of claim 1 in which said housing includes a spring clip for releasably engaging respective said vertical beam to attach said housing and the associated fixture to said framework.

14. The system of claim 1 in which each said lighting fixture is attached to a respective vertical beam such that each said vertical beam has not more than one lighting fixture mounted thereon and wherein said housing of said fixture is connected to an upper end of a respective said vertical conduit segment extending along said vertical beam.

15. The system of claim 1 in which said conduit section includes three perpendicularly interconnected jutting conduit segments mounted respectively on opposing side surfaces and an intermediate inwardly facing surface of a respective said vertical beam.

16. The system of claim 1 in which said housing includes a back panel that carries at least one spring clip for releasably engaging and attaching to a respective vertical beam of said framework to removably attach said lighting fixture to said vertical beam with said back panel of said housing engaging a surface of said vertical beam facing said interior of said enclosure.

17. The system of claim 1 in which each said beam has a rectangular cross sectional shape and a substantially planar inside surface facing interiorly of said enclosure and each said conduit segment has a flat surface for flushly engaging said inside surface of a respective said beam.

* * * * *